US005635004A

United States Patent [19]

Pazdernik et al.

[11] Patent Number: 5,635,004

[45] Date of Patent: Jun. 3, 1997

[54] TAPE APPLYING APPARATUS AND METHODS

[75] Inventors: Irvan L. Pazdernik, Alexandria; Leon J. Krause, Miltona, both of Minn.

[73] Assignee: Douglas Machine Limited Liability Company, Alexandria, Minn.

[21] Appl. No.: 232,838

[22] Filed: Apr. 25, 1994

[51] Int. Cl.[6] ..... B32B 31/00

[52] U.S. Cl. ..... 156/227; 156/475; 156/521

[58] Field of Search ..... 156/517, 521, 156/468, 475, 477.1, 478, 479, 480, 486, 489, 202, 212, 217, 227

[56] References Cited

U.S. PATENT DOCUMENTS

| | | | |
|---|---|---|---|
| 3,447,987 | 6/1969 | Williams | 156/202 X |
| 3,676,266 | 7/1972 | Jensen et al. | 156/521 |
| 3,905,859 | 9/1975 | Patterson | 156/443 |
| 4,227,955 | 10/1980 | Woods et al. | 156/468 X |
| 4,605,459 | 8/1986 | Voltmer et al. | 156/521 X |

*Primary Examiner*—James Engel
*Attorney, Agent, or Firm*—Peterson, Wicks, Nemer & Kamrath, P.A.

[57] ABSTRACT

A tape applying apparatus (10) includes a plurality of pairs of vacuum heads (120, 122) extending axially at circumferentially spaced intervals on a disc (24) rotated about an axis by the extension of a cylinder (48) which is operatively connected by a cam follower (60) to a cam (40) rotatably fixed to the disc (24). The vacuum head (120) adjacent the free end of the tape includes a trough (126) including vacuum bleed holes (128) for drawing the tape segment extending over the trough (126) into the trough (126) to form a tab when desired. A slide (66) is reciprocated between retracted and extended positions by a further cylinder (72). A knife (98) is movably connected to the slide (66) for cutting the tape when the knife (98) reaches a cutting position, with the knife (98) stopping at the cutting position before the slide (66) reaches the extended position. The first ends of first and second arms (74) are pivotably mounted to the slide (66) about spaced pivot axes (76), and rollers (78) are rotatably mounted to the second ends of the arms (74). In the retracted position, the rollers (78) are spaced from the tape segment removably held by the last pair of vacuum heads (120, 122) and from the carton. As the slide (66) moves towards the extended position, the rollers (78) engage the tape and sandwich it against the carton and then roll on the sides of the corner to adhere the tape segment to the corner, with the tape segment being cut and then pulled from the vacuum heads (120, 122) after the rollers (78) are in their engagement position.

27 Claims, 3 Drawing Sheets

TAPE APPLYING APPARATUS AND METHODS

BACKGROUND

The present invention generally relates to apparatus and methods for applying tape, particularly relates to apparatus and methods for applying tape to a carton, and specifically relates to apparatus and methods for applying tape to a corner of a carton.

It is often desired to apply a tape segment to an article such as a carton, with it being further desirable to apply such tape segment mechanically as opposed to manually. For example, one such application of a tape piece or segment would be to hold the folded bottom flaps of an erected carton such as described in PCT International Patent Appln. No. PCT/US 94/01504. Likewise, another application would be to adhere a tape segment to a carton such that U.P.C. codes appear on two panels of the carton.

Additionally, in certain applications for example when the carton is intended to be reused a number of times necessitating that the carton be erected and collapsed a number of times, it is desirable to have the tape segment be provided with a tab which can be easily grasped for stripping the tape segment from the carton. However, in other applications such a tab is not desired.

Thus, a need exists for apparatus and methods for mechanically applying a tape segment especially to the corner of a carton or similar article, with the tape segment being applied with or without a tab for ease of removal of the applied tape segment. Additionally, such apparatus and methods should overcome the many disadvantages and shortcomings of prior attempts of mechanically applying tape segments.

SUMMARY

The present invention solves this need and other problems in the field of the application of tape segments to the corner of a carton or the like by providing, in the most preferred form, method and apparatus for applying a tape segment to a carton wherein a first roller is moved from a retracted position spaced from the carton and spaced from the tape segment removably held intermediate the carton and the roller to an engagement position sandwiching the tape segment against the carton and then to an extended position rolling on the tape segment and the carton, with the tape segment being released after the first roller reaches the engagement position.

In a further aspect of the present invention, method and apparatus are provided for forming a tab at a free end of a tape segment wherein the tape segment extends over a trough formed in a head intermediate the free end of the tape segment and where the tape segment is removably secured to the head, with the trough having a width and depth such that the tape segment will secure upon itself when drawn into the trough.

In a still further aspect of the present invention, method and apparatus are provided for applying a tape segment from an end of a continuous length of tape to a carton wherein a plurality of spaced pairs of vacuum heads are moved relative to the carton, with the tape being removably secured to each of the vacuum heads, with the tape segment being cut from the end of the continuous length of tape, being held adjacent to the carton by one of the plurality of pairs of vacuum heads, being sandwiched against the carton while the tape segment is held by the pair of vacuum heads, and being applied to the carton after the tape segment is pulled from the pair of vacuum heads when a portion of the tape segment is sandwiched against the carton.

It is thus an object of the present invention to provide a novel method and apparatus for forming a tab at the free end of a tape segment.

It is further an object of the present invention to provide such a novel tab forming method and apparatus without clamping or gripping the tape segment.

It is further an object of the present invention to provide such a novel tab forming method and apparatus utilizing vacuum formation.

It is further an object of the present invention to provide a novel method and apparatus for applying a tape segment.

It is further an object of the present invention to provide such a novel tape applying method and apparatus for applying a tape segment to a corner of an article.

It is further an object of the present invention to provide such a novel tape applying method and apparatus wherein the tape is always controlled through application.

It is further an object of the present invention to provide such a novel tape applying method and apparatus when a continuous length of tape is pulled by a vacuum conveyor and not pulled by a tab at the end of the tape.

It is further an object of the present invention to provide such a novel tape applying method and apparatus applying a tape segment with or without a tab.

It is further an object of the present invention to provide such a novel tape applying method and apparatus which removes air bubbles under the tape segment and conforms the tape segment to irregular surfaces.

It is further an object of the present invention to provide such a novel tape applying method and apparatus of a simple design which is not susceptible to wear or breakage and is durable with no high speed moving parts.

It is further an object of the present invention to provide such a novel tape applying method and apparatus which is not prone to cause injury to the operator or others.

It is further an object of the present invention to provide such a novel tape applying method and apparatus wherein the continuous tape is positively indexed, with the tape segment being cut to accurate, consistent lengths.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
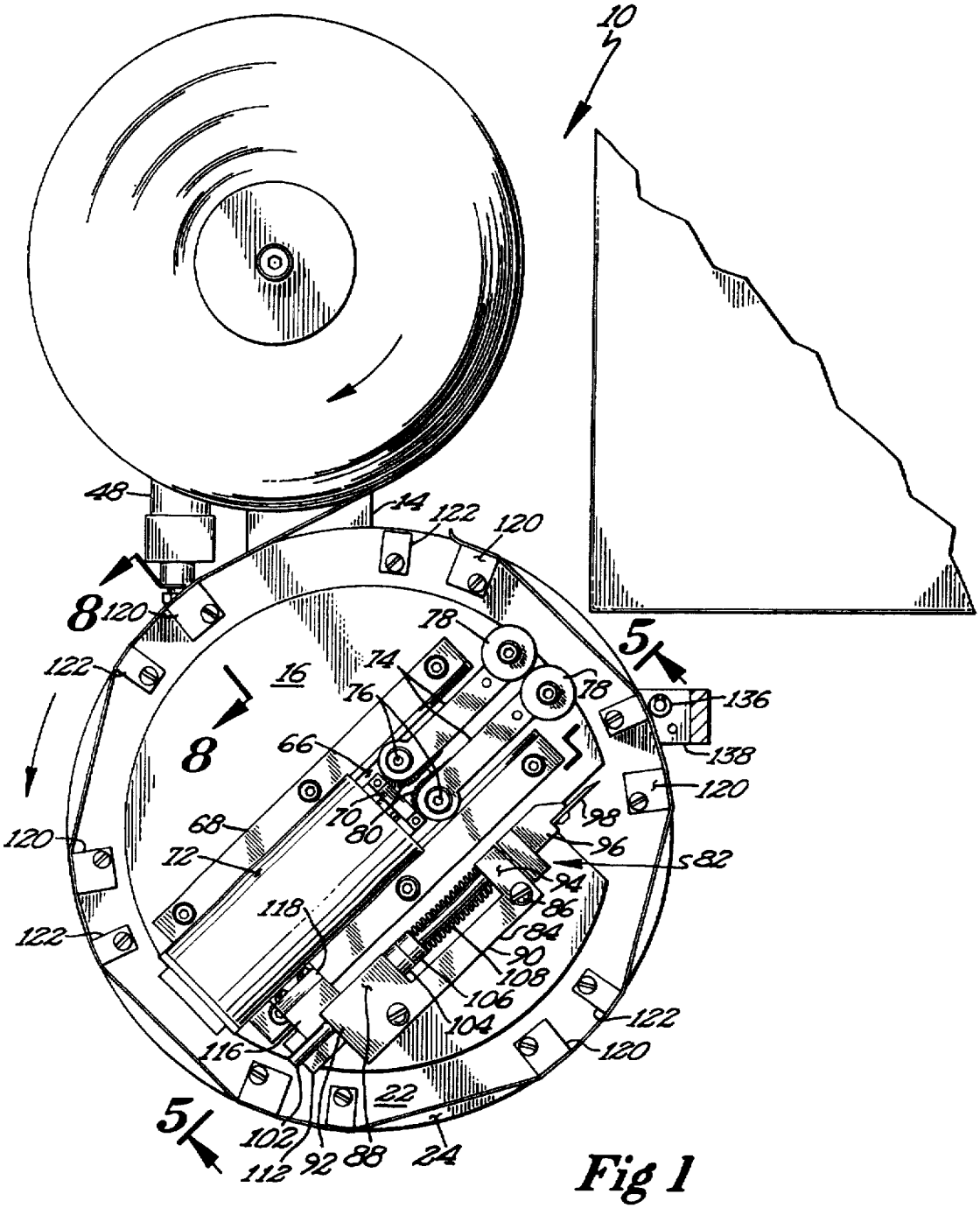
FIG. 1 shows a front elevational view of a tape applying apparatus in the retracted position according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "outer", "upper", "lower", "height", "width", "length", "end", "side", "horizontal", "vertical", "axial", "radial", and similar terms are used herein, it should be understood that these terms have reference only to the structure shown in the drawings as it would appear to a person viewing the drawings and are utilized only to facilitate describing the invention.

DESCRIPTION

An apparatus for applying tape on the corner between first and second sides of a carton or the like according to the preferred teachings of the present invention is shown in the drawings and generally designated 10. Generally, apparatus 10 includes a circular mounting plate 12 which can be secured such as by a suitable mount 14 to any apparatus, not shown, where tape is desired to be dispensed such as but not limited to apparatus for erecting and/or closing a tubular carton. A circular end plate 16 is provided held in a spaced, parallel relation to plate 12 such as by an axial shaft 18 integrally secured to plate 16 such as by welding and adjustably slideably received in a hub 20 formed in plate 12. In the most preferred form, end plate 16 has a diameter smaller than plate 12 and is concentric thereto.

A carrier 22 is rotatably mounted upon shaft 18. In the most preferred form, carrier 22 includes a flat, circular disc 24 having a diameter greater than end plate 16 and in the most preferred form generally equal to plate 12. Disc 24 includes a first axial surface for abutting with and sliding against end plate 16 and a second axial surface on the opposite side of disc 24 than end plate 16. A hub 28 extends axially from the second axial surface of disc 24 and is rotatably mounted upon shaft 18 such as by bearing 30.

An annular fluid communication disc 32 is provided having a center bore of a size for slideable and rotatable receipt upon hub 28 of carrier 22. In the most preferred form, disc 32 has an outer diameter generally equal to plate 12 and disc 24. An annular pressure ring 34 is located on the opposite side of disc 32 than end plate 16 and in the most preferred form has an outer diameter generally equal to the outer diameter of plate 12 and of discs 24 and 32 and an inner diameter generally equal to the outer diameter of end plate 16. Ring 34 includes axial bores for slideable receipt of circumferentially spaced pins 36 extending axially from mounting plate 12 to allow ring 34 to move axially but prevent rotation relative to plate 12. Coil springs 38 are slideably received on each of pins 36 and are sandwiched between plate 12 and ring 34 to thus bias ring 34 towards end plate 16, with discs 24 and 32 being sandwiched between ring 34 and end plate 16. In the most preferred form, ring 34 is secured to disc 32 such as by axially extending screws 39 extending through ring 34 and threaded into disc 32.

Apparatus 10 further includes provisions for rotating carrier 22 in 60° increments in the most preferred form relative to plates 12 and 16, disc 32, and ring 34. In the preferred form, a cam 40 is secured to hub 28 on the opposite side of disc 32 than disc 24, with cam 40 having an outer periphery of a size smaller than the inner diameter of ring 34. In the most preferred form, cam 40 is releasably secured to hub 28 such as by bolts 41. Apparatus 10 further includes a hub 42 rotatably mounted on hub 28 such as by a bearing 44 and on the opposite side of cam 40 than disc 32. A first ear 46 is secured to and extends radially from hub 42. A hydraulic fluid and specifically an air cylinder 48 extends between mount 14 and the free end of ear 46. It can then be realized by extending and retracting cylinder 48, hub 42 is rotated on hub 28 back and forth through an arc of 60° in the most preferred form. A second ear 50 is secured to and extends radially from hub 42 circumferentially spaced 120° from ear 46. A lug 52 extends axially from the radially outer free end of ear 50. A follower assembly 54 is slideably mounted on ear 50 and includes a brace 56 extending generally perpendicular to ear 50 and located intermediate lug 52 and hub 42. A pin is fixed to one of lug 52 or brace 56 and slideably passes through the other of lug 52 or brace 56 and upon which a coil spring 58 is slideably received and sandwiched between lug 52 and brace 56 for biasing follower assembly 54 radially inward on ear 50. A cam follower 60 is rotatably mounted adjacent the radially outer end of follower assembly 54 and radially outward of ear 50.

Figure 4:
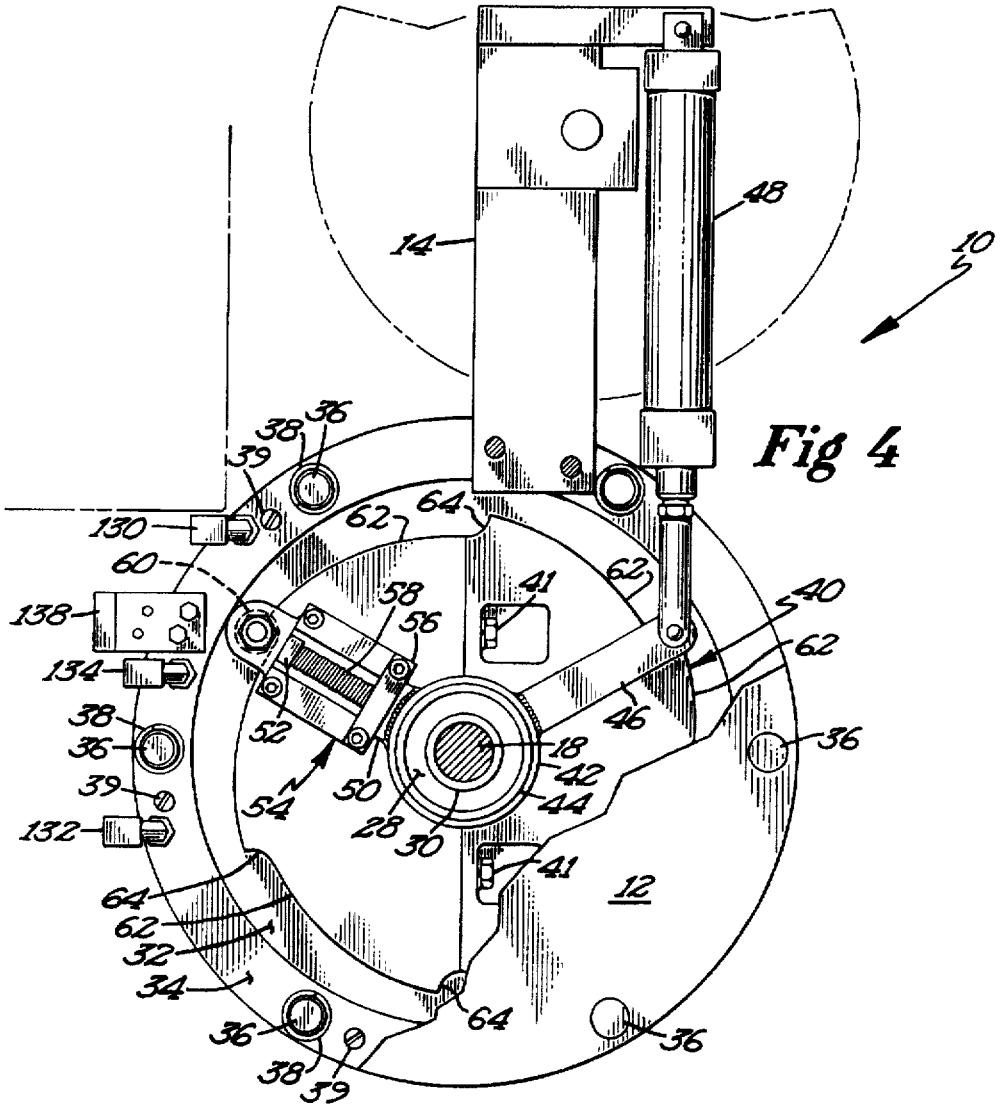
FIG. 4 shows a cross sectional view of the tape applying apparatus of FIG. 1 according to section line 4—4 of FIG. 3.

Cam follower 60 abuts with the outer periphery of cam 40 and is biased by spring 58 to remain in contact therewith. The outer periphery of cam 40 includes a plurality of segments 62 of equal length having gradually decreasing radial spacing from hub 42 and each terminating in a generally radially extending stop 64, with six segments 62 being provided in the most preferred form. Each stop 64 is circumferentially coextensive with the circumferentially adjacent segment 62. In operation and assuming cylinder 48 is in its retracted position and cam follower 60 abuts with stop 64 of one of segments 62 of cam 40 as shown in FIG. 4, cylinder 48 is extended to push ear 46 and thus causing hub 42 to rotate through an arc of 60°. When hub 42 is rotated, ear 50 and follower assembly 54 slideably mounted thereon also rotate through an arc of 60°. Due to the radial orientation of stop 64 and the biasing of cam follower 60 against the outer periphery of Cam 40, rotation of ear 50 and follower assembly 54 rotates cam 40 and hub 28 and carrier 22. Cylinder 48 can then be retracted to pull ear 46 and thus causing hub 42 to rotate in the opposite direction through an arc of 60° back to the initial position. When hub 42 is rotated, ear 50 and follower assembly 54 slideably mounted thereon also rotate in the opposite direction to its initial position. Due to the gradually radially increasing size of segment 62, cam follower 60 will roll on the outer periphery of cam 40 with cam 40 remaining stationary due to its connection to carrier 22 which is held by frictional forces due to the sandwiching of disc 24 between end plate 16 and disc 32 and ring 34. Cam follower 60 moves radially outward against the bias of spring 58 until it is radially aligned with stop 64 of the next segment 62 generally when cylinder 48 reaches its retracted position. When radially aligned with stop 64, cam follower 60 moves radially inwardly under the bias of spring 58 to abut with stop 64 and rotate cam 40 when cylinder 48 is again extended from its retracted position.

Apparatus 10 further includes a slide 66 mounted for slideable radial movement in a slide direction upon end plate 16 such as by mount 68. In the most preferred form, slide 66 includes an axially extending lug 70 spaced from the end thereof. For sliding and reciprocating slide 66 between a first, retracted position and a second, extended position, a hydraulic fluid and specifically an air cylinder 72 is mounted upon mount 68 having the free end of its piston secured to lug 70. First and second arms 74 are pivotably mounted about their first ends to slide 66 about axially extending pivot axes 76. Thus, pivot axes 76 are movable relative to the carton due to the pivotable mounting of arms 74 to slide 66. Rollers 78 are rotatably mounted to the second ends of arms 74 about axially extending pivot axes parallel to and spaced from axes 76. First and second coil springs 80 have first ends secured to slide 66 and the opposite ends attached to first and second arms 74, respectively, adjacent to their second ends, with pivot axes 76 being located inwardly of a straight line through the connection points of springs 80. Springs 80 are stretched around pivot axes 76 and bias arms 74 in a generally parallel arrangement with rollers 78 abutting.

Apparatus 10 generally includes a knife assembly 82 having a mount 84 of a generally U-shaped configuration secured to end plate 16 such as by screws 86. Specifically, mount 84 includes first and second U-shaped legs 88 upstanding in a spaced parallel relation on the opposite axial sides of an axially extending connection 90. Screws 86 extend through connection 90, with first leg 88 abutting with end plate 16 and second leg 88 being spaced from and parallel to first leg 88 and end plate 16. Legs 88 each include first and second, spaced, parallel arms 92 and 94 upstanding from connection 90.

Knife assembly 82 further includes a knife holder 96 for removable attachment of a knife 98. Holder 96 includes a central rod 100 of a size smaller than and for receipt between legs 88 of mount 84. Holder 96 further includes first and second slide pins 102 located on opposite sides of and parallel to rod 100. Pins 102 are spaced from each other a distance corresponding to the spacing between legs 88 and are slideably received in bores formed therein. Specifically, pins 102 are slideable in legs 92 and 94 of legs 88 spaced from and parallel to connection 90 for slideably mounting knife 98 in a direction parallel to the slide direction of slide 66, with rod 100 extending from knife 98 generally parallel to the slide direction of slide 66. First and second collars 104 and 106 are slideably mounted on pins 102 intermediate legs 92 and 94 and are fixed thereon by suitable means such as by set screws. It can then be appreciated that slide pins 102 slideably mount holder 96 relative to mount 84 between a cutting position when collars 106 abut with arms 94 and a retracted position when collars 104 abut with arms 92. It should be noted that collars 104 should abut with arms 92 at the same time and preferably slightly before holder 96 abuts with arms 94 to prevent stress fractures in arms 94.

For moving holder 96 between the cutting and retracted positions, a coil spring 108 is slideably received on rod 100 for abutment with holder 96. A first collar 116 is slideably received on rod 100. A second collar 112 is slideably received on rod 100 for abutment with collar 116 and is fixed on rod 100 by suitable means such as by set screws so as to act as a stop. An attachment arm 118 extends between and attaches and fixes slide 66 to collar 116.

Figure 2:
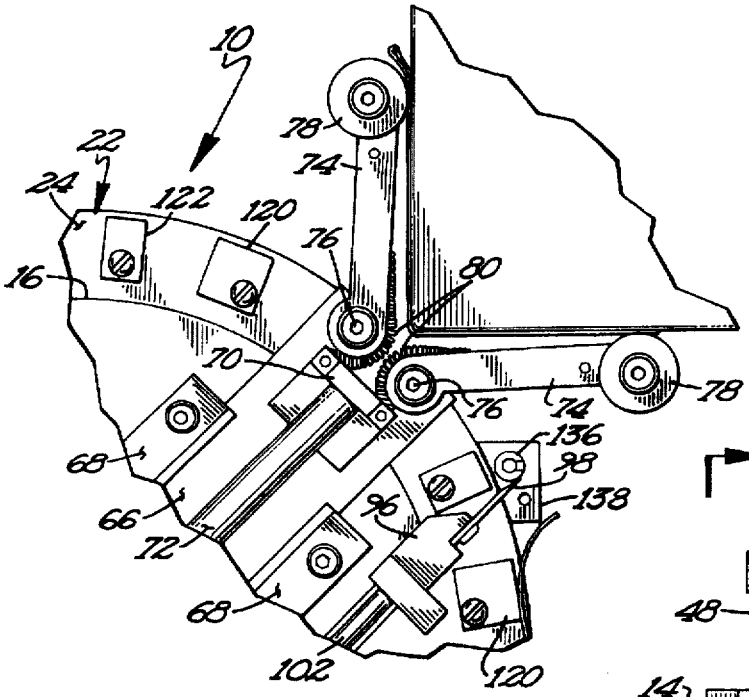
FIG. 2 shows a partial, front elevational view of the tape applying apparatus of FIG. 1 in the extended position.
Figure 5:
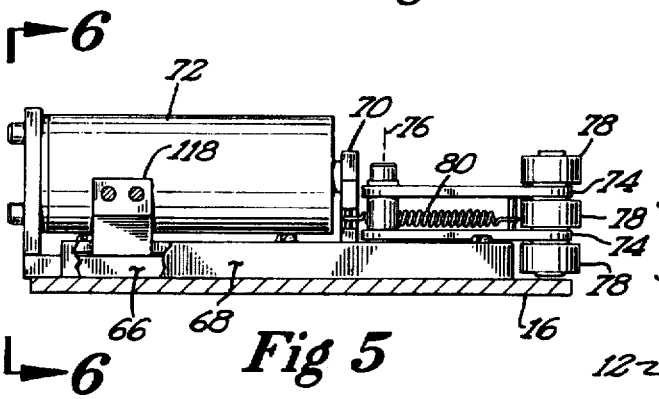
FIG. 5 shows a cross sectional view of the tape applying apparatus of FIG. 1 according to section line 5—5 of FIG. 1.
Figure 6:
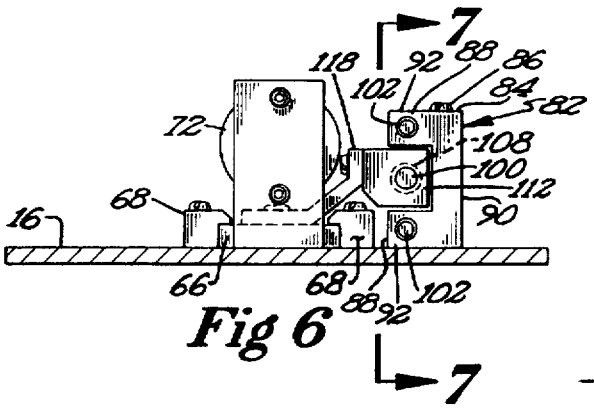
FIG. 6 shows a cross sectional view of the tape applying apparatus of FIG. 1 according to section line 6—6 of FIG. 5.
Figure 3:
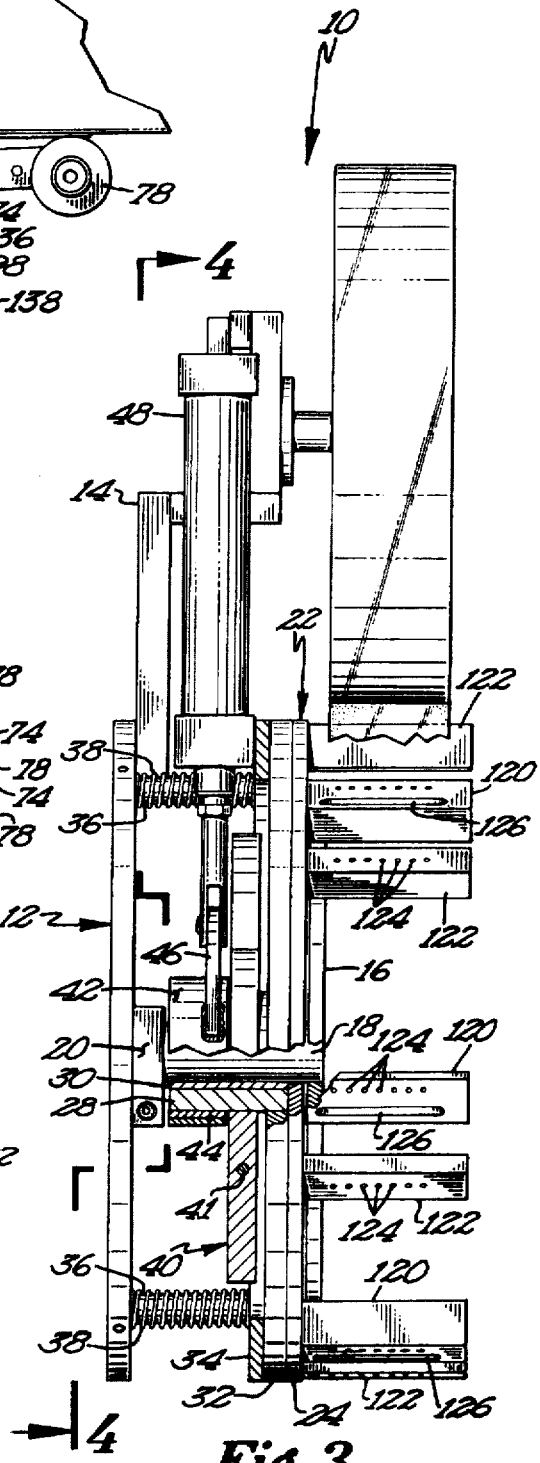
FIG. 3 shows a side elevational view of the tape applying apparatus of FIG. 1, with portions broken away to show constructional details.
Figure 7:
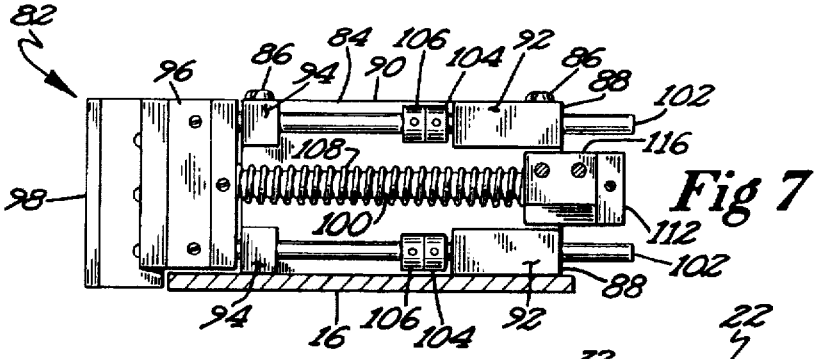
FIG. 7 shows a cross sectional view of the tape applying apparatus of FIG. 1 according to section line 7—7 of FIG. 6.
Figure 8:
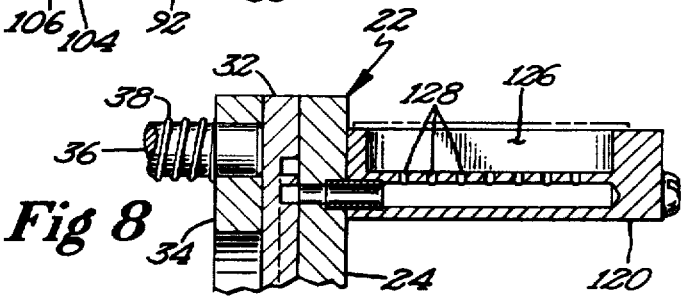
FIG. 8 shows a cross sectional view of the tape applying apparatus of FIG. 1 according to section line 8—8 of FIG. 1.

In operation, with slide 66 in the retracted position as shown in FIGS. 1 and 7, pins 102 are slid in legs 88 with collars 104 abutting with arms 92 and with collar 116 abutting with collar 112. When slide 66 moves towards its extended position by extension of cylinder 72 in the most preferred form, attachment arm 118 secured to collar 116 pushes against spring 108 causing holder 96 to move radially outward. When holder 96 moves radially outward, slide pins 102 slide in legs 88 with collars 106 moving towards arms 94. When knife 98 reaches the cutting position as shown in FIG. 2, collars 106 abut with arms 94 to prevent further movement of collars 106, holder 96, and knife 98 beyond the cutting position. Cylinder 72 has not reached its extended condition when collars 106 abut with arms 94 and knife 98 is in its cutting position. Further movement of cylinder 72 will cause collar 116 to slide upon rod 100 and compress spring 108. When cylinder 72 is retracted from its extended position, collar 116 will slide upon rod 100 until collar 116 abuts with collar 112. With further retraction of cylinder 72, collar 116 will push collar 112 and rod 100 causing holder 96 to move radially inward. When holder 96 moves radially inward, slide pins 102 slide in legs 88 with collars 104 moving towards arms 92. When cylinder 72 reaches its fully retracted position, collars 104 can abut with arms 92 and with holder 96 abutting with and preferably being spaced from arms 94.

Additionally, when slide 66 moves towards its extended position by extension of cylinder 72 in the most preferred form, arms 74 secured to slide 66 move radially outwardly to an engagement position. In the most preferred form, apparatus 10 is arranged such that the corner of the carton is positioned to extend in the nip of rollers 78 carried by arms 74 and with the side panel and bottom flap of the carton in the most preferred form extending at equal angles on the opposite side of the radial slide direction of slide 66. When rollers 78 engage the carton, one of rollers 78 will roll on the side panel of the carton while the other roller 78 will roll on the bottom flap of the carton causing rollers 78 to separate and pivot arms 74 about axes 76 against the bias of springs 80. When cylinder 72 reaches its extended condition as shown in FIG. 2, first and second arms 74 are generally parallel to but spaced from the side and bottom of the carton, respectively. When cylinder 72 is retracted from its extended position, rollers 78 will roll in the opposite direction on the side and bottom of the carton until rollers 78 roll from the carton and abut together. Cylinder 72 can then be retracted to its retracted position as shown in FIG. 1 with rollers 78 and arms 74 radially spaced from the carton.

Carrier 22 according to the teachings of the present invention further includes a plurality of pairs of circumferentially spaced vacuum heads 120 and 122, with six pairs being shown in the most preferred form. Heads 120 and 122 are positioned on disc 24 radially outward of end plate 16, with the pairs of heads 120 and 122 being positioned at equal circumferentially spaced intervals adjacent the periphery of disc 24 and outside of end plate 16. Heads 120 and 122 each include a first series of axially spaced bleed holes 124. Each head 120 further includes an axially extending trough 126 including a second series of axially spaced bleed holes 128 formed in the lower portion thereof. Suitable provisions 130, 132, and 134 shown as an air line nipple in fluid communication within arcuate depressions formed in disc 32 in turn in fluid communication with an axially extending bore in each head 120 and 122 draw a vacuum to bleed holes 124 and 128 at the desired rotational positions of disc 24.

Apparatus 10 according to the preferred teachings of the present invention further includes an anvil roller 136 rotatably mounted to a bracket 138 secured to ring 34 about an axis parallel to shaft 18 and located radially outward of carrier 22. Knife 98 engages with anvil roller 136 in its cutting position to cut tape positioned therebetween.

In operation, a roll of tape is rotatably mounted to mount 14 by any suitable means. With vacuum being provided to bleed holes 124 of at least the last pair of vacuum heads 120 and 122, tape is pulled around the pair of vacuum heads 120 and 122 of disc 24 with the adhesive side of the tape positioned radially outward of heads 120 and 122. The vacuum through bleed holes 124 will removably hold the tape on vacuum heads 120 and 122 intermediate first and second rollers 78 in their retracted position and the corner of the carton. The free end of the tape is located closely adjacent the first vacuum head 120 positioned adjacent the corner of the carton. In the retracted position, rollers 78 are spaced from the corner of the carton and from the tape segment removably held in the last pair of vacuum heads 120 and 122, with the tape segment located intermediate the carton and rollers 78. When cylinder 72 is extended from its retracted position, rollers 78 will move radially and abut with the tape extending between the last pair of vacuum heads 120 and 122 and deflect the segment of the tape extending therebetween to abut with the corner of the carton. After the tape engages the carton and rollers 138 begin to roll on the side and bottom of the carton, knife 98 which is also moving with rollers 78 engages the tape and cuts the tape adjacent anvil roller 136 to thus cut the segment of the tape extending between the last pair of vacuum heads 120 and 122 from the continuous length of tape. With continued extension of cylinder 72 and due to the adherence of the tape to the carton and the sandwiching of the tape between the carton and rollers 78, the tape segment will be pulled and released from vacuum heads 120 and 122 and be pressed upon the carton by rollers 78 as they move to their extended position. After the tape segment has been applied to the carton, cylinder 72 can be retracted from its extended position, with rollers 78 again rolling upon the tape segment to adhere it to the carton until they roll from the carton and reach the retracted position of apparatus 10. At that time, cylinder 48 can be extended from its retracted position to its extended position such that carriage 22 is rotated to place the next pair of vacuum heads 120 and 122 on opposite sides of rollers 78 in a manner as shown in FIG. 1. It is also assumed that the carton to which the tape segment was applied has been removed and replaced with a fresh carton to which a tape segment is desired to be applied.

In certain applications, it is desired to be able to easily remove the tape segment from the carton. For example, such an application is when the carton is to be reused a number of times but shipped or stored in a flat, collapsed condition between uses. Apparatus 10 according to the preferred teachings of the present invention is then able to form at least one tab on the end of the tape segment before its application to the carton. Specifically, as the tape is cut between heads 120 and 122 of adjacent pairs of vacuum heads 120 and 122, the leading end of the tape segment extends circumferentially beyond bleed holes 128 of vacuum head 120 and specifically extends over and circumferentially beyond trough 126. It can then be appreciated that by applying a vacuum to bleed holes 128, the portion of the tape segment extending over trough 126 will be drawn into trough 126 in a generally U-shaped configuration, with the adhesive side facing each other. Trough 126 is formed of a width and depth such that when the tape is drawn therein, it will secure upon itself when the tape reaches the bottom of trough 126 to form the tab. In the most preferred form, vacuum is only applied to bleed holes 128 of any particular vacuum head 120 after the tape has been cut by knife 98 circumferentially in front thereof. As the tab on the leading end of the tape segment does not have exposed adhesive, it does not adhere to the carton and can be easily grasped and pulled when it is desired to remove the tape segment from the carton.

Apparatus 10 according to the preferred teachings of the present invention can be controlled to apply the tape segment to the carton either with or without the tab by simply either applying or not applying vacuum to bleed holes 128. However, it can be appreciated that the length of the tape segment adhered to the carton changes depending upon whether or not a tab is present. In the most preferred form, it is desired to apply the tape segment so that equal portions are secured to the side and bottom of the carton. This can be accomplished in apparatus 10 of the preferred embodiment by changing the configuration of knife holder 96 and the position of anvil roller 136 such that knife 98 cuts the tape at different positions. In the preferred form, bolts 41 are loosened to adjust the rotational position of disc 24 relative to cam 40 to allow knife 98 and holder 96 to pass without abutment between vacuum head 122 of the last pair of vacuum heads 120 and 122 and vacuum head 120 of the next circumferentially adjacent pair of vacuum heads 120 and 122.

Now that the basic construction and operation of apparatus 10 according to the preferred teachings of the present invention has been explained, further subtle features and advantages of apparatus 10 can be set forth and appreciated. In particular, the tape can be supplied from any diameter roll and apparatus 10 can be adapted to any roll holder. Additionally, the tape roll can be easily changed when necessary or desired. The tape need only be attached to the initial pairs of vacuum heads 120 and 122 and then carrier 22 rotated to position the leading end of the tape beyond the corner of the carton. Thus, the tape is self tracking on carrier 22, and no need exists to pass fingers through in front of knife 98 and cutting anvil roller 136. Additionally, knife 98 is generally not exposed so as to cause injury to the operator or persons adjacent apparatus 10. Further knife 98 is of a standard, off the shelf design to reduce costs.

Tape can be applied to the carton by apparatus 10 according to the preferred teachings of the present invention with or without tabs. In this regard, the tape is pulled only by vacuum around the perimeter of carrier 22 and specifically does not use or require a tab at the end of the tape. Further, when desired, the tabs are formed by the use of vacuum, with no clamping or gripping of the tape. Likewise, the tape is always under the control of vacuum heads 120 and 122 and/or rollers 78 such that loss or adherence to itself does not occur. Further, tape is positively indexed by carrier 22 and the tape segments can be cut to have very accurate lengths and specifically will not fail to be pulled under normal conditions.

The application of the tape segment to the carton by rollers 78 pivotably mounted on pivotable arms 74 of apparatus 10 according to the preferred teachings of the present invention is advantageous. Specifically, rollers 78 roll out any air bubbles between the tape segment and the carton. Further, the pivotable movement about axes 76 allows rollers 78 to conform to irregular shapes such as would be encountered when the carton has been previously erected, used, and collapsed a number of times.

Apparatus 10 of the preferred form is of a simple design which requires no electrical hookups aside from for control of the application of the vacuum and requires only the use of one vacuum air line, with only two, common end mount air cylinders 48 and 72 being utilized. As no pump is used, very little vacuum is required, with a Venturi being utilized in the most preferred form. Further, apparatus 10 does not use any radical mechanical linkages or an excessive number of bearings which are easily susceptible to wear and breakage and utilizes no high speed moving parts which makes apparatus 10 more durable.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparatus for applying a tape segment to a corner between first and second sides of a carton comprising, in combination: a first roller for rolling on the first side of the carton; a second roller for rolling on the second side of the carton; means for moving the first and second rollers from a retracted position spaced from the corner to an engagement position engaging the first and second sides of the carton and then rolling on the first and second sides to an extended position; means for removably holding the tape segment intermediate the first and second rollers in their retracted position and the corner of the carton and for releasing the tape segment after the first and second rollers are in their engagement position; a knife for cutting the tape segment from a continuous length of tape; and means for moving the knife between the retracted position spaced from the tape and a cutting position as the rollers move from the retracted position to the extended position with the knife reaching the cutting position before the rollers reach the extended position and the knife stopping without further movement beyond the cutting position as the rollers continue to move towards the extended position.

2. The apparatus of claim 1 wherein the rollers moving means comprises, in combination: first and second arms having first and second ends; means for pivotably mounting the first ends of the first and second arms about spaced pivot axes; and means for moving the pivot axes relative to the carton, with the first and second rollers being rotatably mounted to the second ends of the first and second arms.

3. The apparatus of claim 2 wherein the pivot axes moving means comprises, in combination: a slide, with the first ends of the first and second arms being pivotably mounted to the slide about the pivot axes; and means for reciprocating the slide in a slide direction between the retracted and extended positions.

4. The apparatus of claim 3 wherein the knife moving means comprises, in combination: means for movably connecting the knife to the slide with the knife reaching the cutting position before the rollers reach the extended position and the knife stopping without further movement beyond the cutting position.

5. The apparatus of claim 4 wherein the movably connecting means comprises, in combination: means for slideably mounting the knife in a direction parallel to the slide direction of the slide; a rod extending from the knife generally parallel to the slide direction and having a free end; a stop fixed on the free end of the rod; a collar fixed to the slide and slideable on the rod; and a spring located on the rod between the collar and the knife.

6. The apparatus of claim 3 wherein the removably holding means comprises a spaced pair of vacuum heads, with the first and second rollers in the retracted position being positioned between the pair of vacuum heads.

7. The apparatus of claim 6 wherein at least one of the pair of vacuum heads includes a trough, with the tape segment extending over the trough; and wherein the apparatus further comprises, in combination: means for drawing the tape segment into the trough, with the trough having a width and depth such that the tape will secure upon itself when drawn into the trough.

8. The apparatus of claim 6 wherein a plurality of spaced pairs of vacuum heads are provided; and wherein the apparatus further comprises, in combination: means for moving the plurality of spaced pairs of vacuum heads relative to the first and second rollers, with movement of the plurality of spaced pairs of vacuum heads removing the continuous length of tape from a roll, with the knife cutting the continuous length of tape removably held by at least two of the pairs of vacuum heads and intermediate the two pairs of vacuum heads.

9. The apparatus of claim 8 wherein the vacuum heads moving means comprises, in combination: a disc rotatable about an axis, with the pairs of vacuum heads extending axially at circumferentially spaced intervals on the disc; and means for rotating the disc in a single direction about the axis.

10. The apparatus of claim 9 wherein the rotating means comprises, in combination: a cam rotatable with the disc about the axis, with the cam having an outer periphery including a plurality of radially extending stops; and an extendable and retractable cylinder having a variable length and a free end; and means operatively connected to the free end of the cylinder for abutting with one of the radially extending stops when the cylinder extends and for moving relative to the outer periphery when the cylinder retracts.

11. The apparatus of claim 10 wherein the operatively connected means comprises, in combination: a hub rotatable about the axis; a first ear radially extending from the hub, with the free end of the cylinder pivotably connected to the first ear; a second ear radially extending from the hub; and a cam follower mounted to the second ear and engageable with the outer periphery and the radially extending stops of the cam.

12. The apparatus of claim 1 wherein the removably holding means comprises a plurality of spaced pairs of vacuum heads, with the first and second rollers in the retracted position being positioned between one of the pairs of vacuum heads; and wherein the apparatus further comprises, in combination: means for moving the plurality of spaced pairs of vacuum heads relative to the first and second rollers, with movement of the plurality of spaced pairs of vacuum heads removing the continuous length of tape from a roll, with the knife cutting the continuous length of tape removably held by at least two of the pairs of vacuum heads and intermediate the two pairs of vacuum heads.

13. The apparatus of claim 12 wherein the vacuum heads moving means comprises, in combination: a disc rotatable about an axis, with the pairs of vacuum heads extending axially at circumferentially spaced intervals on the disc; and means for rotating the disc in a single direction about the axis.

14. The apparatus of claim 13 wherein the rotating means comprises, in combination: a cam rotatable with the disc about the axis, with the cam having an outer periphery including a plurality of radially extending stops; and an extendable and retractable cylinder having a variable length and a free end; and means operatively connected to the free end of the cylinder for abutting with one of the radially extending stops when the cylinder extends and for moving relative to the outer periphery when the cylinder retracts.

15. The apparatus of claim 1 wherein the removably holding means comprises a spaced pair of vacuum heads, with the first and second rollers in the retracted position being positioned between the pair of vacuum heads, with at least one of the pair of vacuum heads including a trough, with the tape segment extending over the trough; and wherein the apparatus further comprises, in combination: means for drawing the tape segment into the trough, with the trough having a width and depth such that the tape will secure upon itself when drawn into the trough.

16. Apparatus for applying a tape segment to a corner between first and second sides of a carton comprising, in combination: a first roller for rolling on the first side of the carton; a second roller for rolling on the second side of the carton; means for moving the first and second rollers from a retracted position spaced from the corner to an engagement position engaging the first and second sides of the carton and then rolling on the first and second sides to an extended position comprising, in combination: a slide, with the first and second rollers being mounted to the slide; and means for reciprocating the slide in a slide direction between the retracted and extended positions; means for removably holding the tape segment intermediate the first and second rollers in their retracted position and the corner of the carton and for releasing the tape segment after the first and second rollers are in their engagement position; a knife for cutting the tape segment from a continuous length of tape; and means for movably connecting the knife to the slide with the knife reaching the cutting position before the rollers reach the extended position and the knife stopping without further movement beyond the cutting position, with the movably connecting means comprising, in combination: means for slideably mounting the knife in a direction parallel to the slide direction of the slide; a rod extending from the knife generally parallel to the slide direction and having a free end; a stop fixed on the free end of the rod; a collar fixed to the slide and slideable on the rod; and a spring located on the rod between the collar and the knife.

17. Apparatus for forming a tab at the free end of a tape segment comprising, in combination: a head; means formed in the head for removably securing to the tape segment spaced from the free end; a trough formed in the head and located intermediate the free end and the removably securing means, with the tape segment extending over the trough; and means for drawing the tape segment into the trough, with the trough having a width and depth such that the tape segment will secure upon itself when drawn into the trough.

18. The method of claim 17 wherein the drawing means comprises means for drawing the tape segment into the trough without clamping or gripping the tape segment within the trough.

19. Method for applying a tape segment to a carton comprising the steps of: removably holding the tape segment adjacent to the carton; moving a first roller from a retracted position spaced from the carton and located on the opposite side of the tape segment than the carton to an engagement position sandwiching the tape segment against the carton and then to an extended position rolling on the tape segment and the carton, with the tape segment being released after the first roller reaches the engagement position; and forming a tab at a free end of the tape segment comprising the steps of: removably securing a head to the tape segment spaced from the free end of the tape segment; and drawing the tape segment extending over a trough formed in the head intermediate the free end of the tape segment and where the tape segment is removably secured to the head, with the trough having a constant width and depth such that the tape segment will secure upon itself when drawn into the trough.

20. The method of claim 19 wherein the tape segment is applied to a corner between first and second sides of the carton and further comprises the steps of: moving a second roller from a retracted position spaced from the carton and located on the opposite side of the tape segment than the carton to an engagement position sandwiching the tape segment against the carton and then to an extended position rolling on the tape segment and on the second side of the carton, with the first roller rolling on the first side of the carton.

21. The method of claim 20 further comprising the step of cutting the tape segment from the end of a continuous length of tape.

22. The method of claim 21 wherein the cutting step comprises the step of moving a knife with the first and second rollers, with the knife reaching a cutting position before the rollers reach the extended position and stopping further movement beyond the cutting position.

23. Method for forming a tab at a free end of a tape segment comprising the steps of: removably securing a head to the tape segment spaced from the free end of the tape segment; and drawing the tape segment extending over a trough formed in the head intermediate the free end of the tape segment and where the tape segment is removably secured to the head, with the trough having a constant width and depth such that the tape segment will secure upon itself when drawn into the trough.

24. The method of claim 23 wherein the drawing step comprises the step of drawing the tape segment into the trough without clamping or gripping the tape segment within the trough.

25. Apparatus for applying a tape segment from an end of a continuous length of tape to a carton comprising, in combination: a plurality of spaced vacuum heads, with each of the vacuum heads including means for removably securing to the tape; means for moving the plurality of vacuum heads relative to the carton; means for cutting the tape segment from the end of the continuous length of tape, with the tape segment being held adjacent to the carton by at least one of the vacuum heads; and means for sandwiching the tape segment against the carton while the tape segment is held by the vacuum head; wherein the moving means comprises, in combination: means for mounting the plurality of vacuum heads for rotation about an axis; a cam rotatable with the plurality of vacuum heads while the tape is removably held by the vacuum heads about the axis, with the cam having an outer periphery including a plurality of radially extending stops; and an extendable and retractable cylinder having a variable length and a free end; and means operatively connected to the free end of the cylinder for abutting with one of the radially extending stops when the cylinder extends and for moving relative to the outer periphery when the cylinder retracts.

26. The apparatus of claim 25 wherein the mounting means comprises a disc rotatable about an axis, with the vacuum heads extending axially at circumferentially spaced intervals on the disc.

27. The apparatus of claim 25 wherein the operatively connected means comprises, in combination: a hub rotatable about the axis; a first ear radially extending from the hub, with the free end of the cylinder pivotably connected to the first ear; a second ear radially extending from the hub; and a cam follower mounted to the second ear and engageable with the outer periphery and the radially extending stops of the cam.

* * * * *

UNITED STATES PATENT AND TRADEMARK OFFICE

CERTIFICATE OF CORRECTION

PATENT NO. : 5,635,004

DATED : June 3, 1997

INVENTOR(S) : Pazdernik et al.

It is certified that error appears in the above-indentified patent and that said Letters Patent is hereby corrected as shown below:

Column 11, line 44, between "free end" and ";" insert --so that the tape is free of securement between the free end and the removably securing means--.

Column 11, line 48, between "having a" and "width" insert --constant--.

Column 11, line 64, between "tape segment" and ";" insert --so that the tape is free of securement between the free end and where the tape segment is removably secured to the head--.

Column 12, line 23, between "tape segment" and ";" insert --so that the tape is free of securement between the free end and where the tape segment is removably secured to the head--.

Signed and Sealed this

Sixteenth Day of September, 1997

Bruce Lehman

*Attest:*

BRUCE LEHMAN

*Attesting Officer*

*Commissioner of Patents and Trademarks*